US008981269B2

(12) United States Patent
Park et al.

(10) Patent No.: US 8,981,269 B2
(45) Date of Patent: Mar. 17, 2015

(54) COOKER

(75) Inventors: Yong-Ho Park, Changwon-si (KR); Jun-Hyun Park, Changwon-si (KR); Wang-Lim Lee, Changwon-si (KR); Dae-Eun Kim, Changwon-si (KR); Dong-Heon Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1115 days.

(21) Appl. No.: 12/994,787

(22) PCT Filed: May 27, 2009

(86) PCT No.: PCT/KR2009/002815

§ 371 (c)(1),
(2), (4) Date: Mar. 21, 2011

(87) PCT Pub. No.: WO2009/145566

PCT Pub. Date: Dec. 3, 2009

(65) Prior Publication Data

US 2011/0163089 A1 Jul. 7, 2011

(30) Foreign Application Priority Data

May 29, 2008 (KR) ..... 10-2008-0050485
May 29, 2008 (KR) ..... 10-2008-0050488

(51) Int. Cl.
*H05B 6/64* (2006.01)
*H05B 6/68* (2006.01)
*F24C 15/00* (2006.01)

(52) U.S. Cl.
CPC ..... *F24C 15/008* (2013.01); *H05B 6/6423* (2013.01); *H05B 6/6435* (2013.01); *H05B 6/6444* (2013.01)
USPC ..... 219/679; 219/758

(58) Field of Classification Search
CPC .. F24C 15/008; H05B 6/6444; H05B 6/6435; H05B 6/3423
USPC ..... 219/679, 647, 756–758, 720, 702, 770, 219/779, 391, 396, 453; 362/92; 426/88, 426/233; 99/386
See application file for complete search history.

(56) References Cited

U.S. PATENT DOCUMENTS 5,747,783 A * 5/1998 Myung et al. ..... 219/758
2002/0084269 A1* 7/2002 Kim ..... 219/757

FOREIGN PATENT DOCUMENTS

JP 2006-017390 1/2006
JP 2006-017390 A 1/2006
KR 10-2005-0056723 6/2005
KR 10-0690161 B1 2/2007

(Continued)

OTHER PUBLICATIONS

Korean Office Action dated Jan. 30, 2010 issued in Application No. 10-2008-0050485.
Korean Office Action dated Jan. 30, 2010 issued in Application No. 10-2008-0050488.

(Continued)

*Primary Examiner* — Quang Van
(74) *Attorney, Agent, or Firm* — Ked & Associates, LLP

(57) ABSTRACT

A cooker is provided. According to an operation of the cooker, light having color different from each other is emitted into a cooking chamber according to whether it is in a cooking mode for cooking a food or a keep-warm mode for keeping the food warm. Thus, a user may easily confirm whether the food is cooked or kept warm. In addition, the food may be kept warm through a further simple structure.

18 Claims, 4 Drawing Sheets

(56) References Cited

FOREIGN PATENT DOCUMENTS

| | | |
|---|---|---|
| KR | 10-0690161 | 3/2007 |
| KR | 10-2007-0053569 | 5/2007 |
| KR | 10-2007-0053569 A | 5/2007 |

OTHER PUBLICATIONS

International Search Report issued in PCT Application No. PCT/KR2009/002815 dated May 27, 2009.

* cited by examiner

COOKER

TECHNICAL FIELD

The present disclosure relates to a cooker, and more particularly, to a cooker having a keep warm function.

BACKGROUND ART

Cookers are home appliances that cook foods using gas or electricity.

Cookers putting on the market in recent have a keep warm function for keeping foods ward. The keep warm function may be executed after foods are cooked or irrelevant to the cooking of foods.

DISCLOSURE

Technical Problem

However, a cooker having a related art keep warm function has limitations as follows.

In a related art cooker, a user does not confirm a state within a cooking chamber such as cooking or keeping warm of foods. That is, the user does not determine whether the foods within the cooking chamber is cooked or kept warm by a heating source.

Also, an illumination source for illuminating the inside of a cooking chamber in which foods are cooked or keep warm and a heating source for keeping foods warm are separately provided. Thus, there is a limitation that the number of parts constituting a product is increased.

Technical Solution

Embodiments provide a cooker capable of easily confirming whether a food is kept warm.

Embodiments also provide a cooker capable of keeping a food warm through a further simple structure.

In one embodiment, a cooker includes: at least one heating source providing heat supplied into a cooking chamber; an illumination device illuminating the inside of the cooking chamber; a controller controlling the heating source to perform a cooking mode for cooking a food in the cooking chamber or a keep-warm mode for keeping the food warm in the cooking chamber and the illumination device to emit light having colors different from each other into the cooking chamber according to the cooking mode or the keep-warm mode.

In another embodiment, a cooker includes: at least one heating source performing all or at least keep-warm mode of a cooking mode for cooking a food in a cooking chamber and the keep-warm mode for keeping the food warm in the cooking chamber; a first illumination source emitting light for illuminating the inside of the cooking chamber in the cooking mode; a second illumination source emitting light for illuminating the inside of the cooking chamber in the cooking mode; and a light-converting member converting a color of the light emitted from one of the first and second illumination sources to transmit the light having the converted color into the inside of the cooking chamber.

In further another embodiment, a cooker includes: a cavity having a cooking chamber eccentrically disposed on a front surface thereof; a hood exhaust passage disposed on an upper portion of the cavity; a vent fan assembly generating an airflow flowing into the hood exhaust passage; a heating source disposed at a side of a top surface of the cavity except the hood exhaust passage, the heating source providing heat for keeping a food warm in at least the cooking chamber; and an illumination device disposed above the hood exhaust passage, the illumination device emitting light having colors different from each other according to whether it is in a cooking mode in which the food is cooked in the cooking chamber or a keep-warm mode in which the food is kept warm in the cooking chamber.

*10In still further another embodiment, a cooker includes: a cavity having a cooking chamber in which a food is cooked or kept warm; an air duct disposed on a top surface of the cavity, the air duct having a hood exhaust passage; a heating source disposed on a top surface of the air duct except the hood exhaust passage, the heating source providing heat for cooking the food or keeping the food warm in the cooking chamber; and an illumination device disposed above the hood exhaust passage, the illumination device illuminating the inside of the cooking chamber.

Advantageous Effects

According to the embodiments, the user may easily confirm whether the food is cooked or kept warm. In addition, the food may be kept warm through the further simple structure.

BEST MODE

Hereinafter, a configuration of a cooker according to a first embodiment will be described in detail with reference to accompanying drawings.

Figure 1:
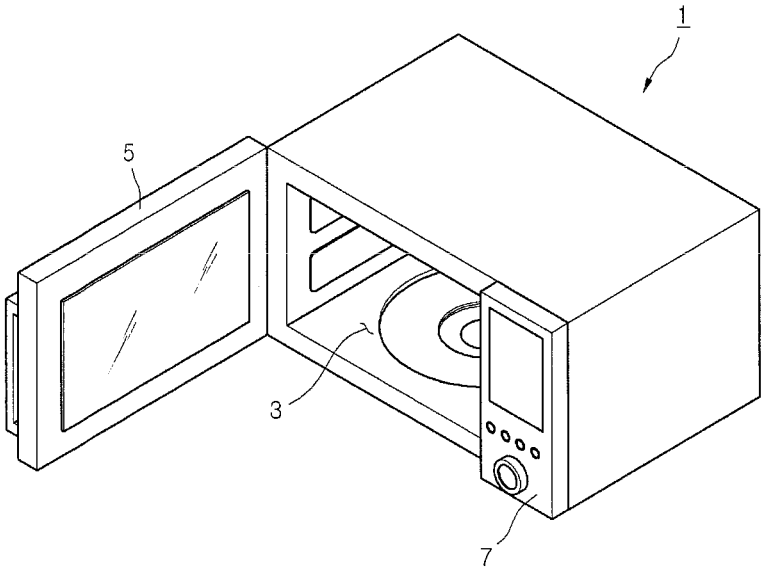
FIG. 1 is a perspective view of a cooker according to a first embodiment.
Figure 2:
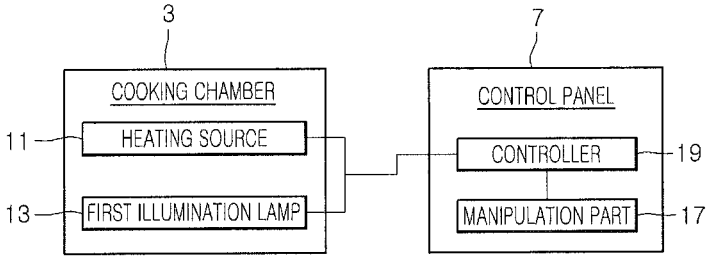
FIG. 2 is a block diagram of the cooker according to the first embodiment.

FIG. 1 is a perspective view of a cooker according to a first embodiment, and FIG. 2 is a block diagram of the cooker according to the first embodiment. In the current embodiment, a cooker of cooking equipment will be described as example.

Referring to FIG. 1, a cooking chamber 3 is defined in a cooker main body 1. The cooking chamber is a space for cooking a food or keeping a food warm.

The cooking chamber 3 is selectively opened or closed by a door 5. The other end of the door 5 is installed pivotably on the main body 1 in front and rear directions, centered about one end thereof.

Also, a control panel 7 is disposed on a side of a front surface of the main body 1. The control panel 7 receives a manipulation signal for operating the cooker and controls an operation of the cooker.

Referring to FIG. 2, a plurality of heating sources is disposed in the cooker. For example, the cooker may include a magnetron oscillating a microwave for cooking a food or keeping the food warm in the cooking chamber 3 and a heating source 11 such as a heater generating heat. The heating source 11 may include a heat source for cooking the food in the cooking chamber 3 and a heating source for keeping the food warm in the cooking chamber 3. Here, the heating source for cooking the food is separated from the heating source for keeping the food warm. Alternatively, one heating source 11 may be provided to cook the food or keep the food warm in the cooking chamber 3.

An illumination lamp 13 is disposed in the cooker. The illumination lamp 13 illuminates the inside of the cooking chamber 3 when the cooker is operated to cook the food or keep the food warm in the cooking chamber 3. Here, the illumination lamp 13 is configured to emit light having at least two colors. This is done for a reason that the inside of the cooking chamber 3 is illuminated by light having colors different from each other according to the cooking or keeping warm of the food in the cooking chamber 3 to allow the user to distinguish whether the food within the cooking chamber 3 is cooked or kept warm. For example, the illumination lamp 13 may emit light having two colors such as yellow light and red light.

The control panel 7 includes a manipulation part 17. The manipulation part 17 receives a manipulation signal for an operation of the cooker. Particularly, the manipulation part 17 receives the manipulation signal for cooking the food or keeping the food warm in the cooking chamber 3. Here, the manipulation part 17 may receive the manipulation signal for keeping the food warm in a form that is actively selected by the user or a form that is not passively selected by the user.

The control panel 7 includes a controller 19. The controller 19 controls an operation of the cooker, in particular, operations of the heating source 11 and the illumination lamp 13 according to the manipulation signal inputted into the manipulation part 17.

In more detail, the controller 19 controls the operation of the heating source 11 according to whether the manipulation part 17 receives the manipulation signal for cooking the food in the cooking chamber or the manipulation signal for keeping the food warm. Here, when the food is not kept warm in the cooking chamber 3, but is cooked in the cooking chamber 3, the heating source is driven to high output under the control of the controller 19. If the heating source is divided into a heating source for cooking the food in the cooking chamber 3 and a heating source for keeping the food warm in the cooking chamber 3, the controller 19 controls the heating source for cooking the food or the heating source for keeping the food warm in the cooking chamber 3 to operate the heating source.

The controller 19 controls an operation of the illumination lamp 13 according to whether the manipulation part 17 receives the manipulation signal for cooking the food or the manipulation signal for keeping the food warm in the cooking chamber 3. For example, when the manipulation part 17 receives the manipulation signal for cooking the food in the cooking chamber 3, the controller 19 controls the illumination lamp 13 to emit the yellow light for illuminating the inside of the cooking chamber 3. When the manipulation part 17 receives the manipulation signal for keeping the food warm in the cooking chamber 3, the controller 19 controls the illumination lamp 13 to emit the red light for illuminating the inside of the cooking chamber 3.

Hereinafter, an effect of the cooker according to the first embodiment will be described in detail.

First, the user inputs the manipulation signal for cooking the food into the manipulation part 17. When the manipulation part 17 receives the manipulation signal for cooking the food, the controller 19 controls operations of the heating source 11 and the illumination lamp 13. Thus, the heating source 11 is operated to perform a cooking mode in which the food within the cooking chamber 3 is cooked. Also, the illumination lamp 13 is operated to illuminate the inside of the cooking chamber 3. At this time, the controller 19 controls the illumination lamp 13 to emit the yellow light. Thus, since the yellow light is emitted into the cooking chamber 3, the user may know that the food is cooked in the cooking chamber 3.

When the user inputs the manipulation signal for keeping the food warm into the manipulation part 17, a keep-warm mode is performed. The input of the manipulation signal for starting the keep-warm mode may be performed at the same time with the input of the manipulation signal for starting the cooking mode or may be performed during the cooking mode. Also, the keep-warm mode may be started when the user does not actively input the manipulation signal in which the keep-warm mode is not started into the manipulation part 17.

When the keep-warm mode is performed, the controller 19 controls the heating source 11 to keep the food warm in the cooking chamber 3. Also, the controller 19 controls the illumination lamp 13 to emit the red light, thereby illuminating the inside of the cooking chamber 3.

MODE FOR INVENTION

Hereinafter, a cooker according to a second embodiment will be described in detail with reference to accompanying drawings.

Figure 3:
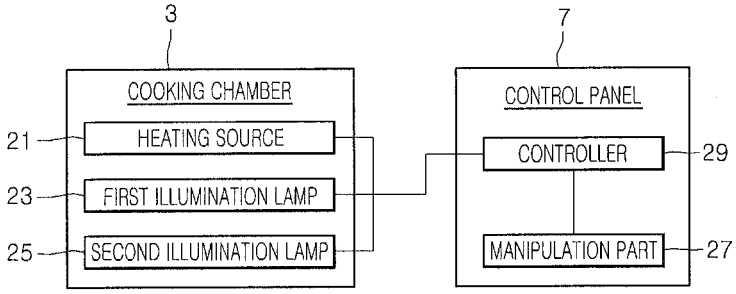
FIG. 3 is a block diagram of a cooker according to a second embodiment.

FIG. 3 is a block diagram of a cooker according to a second embodiment. In the current embodiment, the same part as that of the first embodiment will be denoted in detail by the reference numerals of FIG. 1.

Referring to FIG. 3, in a cooker according to the second embodiment, a heating mode in which a food within a cooking chamber 3 is heated by a heating source 21 or a keep-warm mode in which the food is kept warm are performed. Also, the inside of the cooking chamber 3 is illuminated by first and second illumination lamps 23 and 25. The first illumination lamp 23 illuminates the inside of the cooking chamber 3 in the heating mode. The second illumination lamp 25 illuminates the inside of the cooking chamber 3 in the keep-warm mode. The first and second illumination lamps 23 and 25 emit light having colors different from each other. For example, the first illumination lamp 23 may emit yellow light, and the second illumination lamp 25 may emit red light. However, the present invention is not limited to the colors of light of the first and second illumination lamps 23 and 25. That is to say, if the first and second illumination lamps 23 and 25 emit light having colors different from each other, the first and second illumination lamps 23 and 25 may emit light having certain colors.

A manipulation part 27 constituting a control panel 7 receives various manipulation signals for an operation of the cooker including the cooking mode function or the keep-warm mode function. A controller 29 constituting the control panel 7 controls operations of the heating source 21 and the first and second illumination lamps 23 and 25 according to the manipulation signals inputted into the manipulation part 27, i.e., the manipulation signals for the cooking mode or the keep-warm mode.

In more detail, when the manipulation part 27 receives the manipulation signal for the cooking mode, the controller 29 controls the first illumination lamp 23 to illuminate the inside of the cooking chamber 3. When the manipulation part 27 receives the manipulation signal for the keep-warm mode, the controller 29 controls the second illumination lamp 25 to illuminate the inside of the cooking chamber 3.

That is to say, in the above-described first embodiment, the controller controls one illumination lamp to emit light having colors different from each other into the cooking chamber according to whether it is in the cooking mode or the keep-warm mode. However, in the current embodiment, the controller 29 controls one of the first and second illumination lamps 23 and 25, which respectively emit light having colors different from each other to emit light having colors different from each other into the cooking chamber 3 according to whether it is in the cooking mode or the keep-warm mode.

Also, the current embodiment, although the heating source 21 and the second illumination lamp 25 are provided as separate parts, it is not limited thereto. For example, a halogen lamp may be used as the heating source 21 and the second illumination lamp 25. Thus, when the manipulation part 27 receives the manipulation signal for the keep-warm mode, the controller 29 controls an operation of the halogen lamp to keep the food warm in the cooking chamber 3. However, since the halogen lamp emits red light during operation, red light is illuminated into the cooking chamber 3, and simultaneously, the food is kept warm in the cooking chamber 3. Thus, the keeping warm of the food and the illumination of the inside of the cooking chamber 3 may be performed by the halogen lamp.

Hereinafter, a cooker according to a third embodiment will be described in detail.

Figure 4:
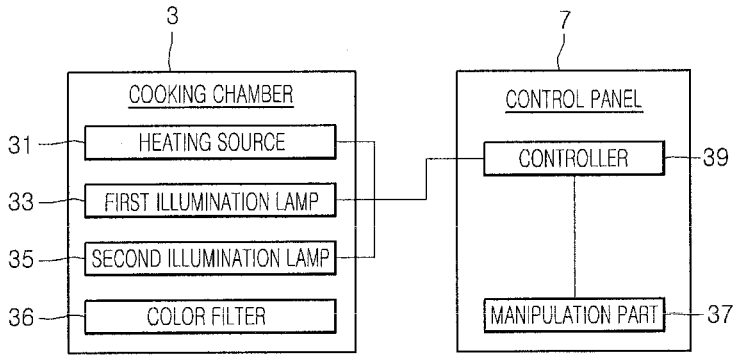
FIG. 4 is a block diagram of a cooker according to a third embodiment.

FIG. 4 is a block diagram of a cooker according to a third embodiment. In the current embodiment, the same part as that of the first embodiment will be denoted in detail by the reference numerals of FIG. 1.

Referring to FIG. 4, in the current embodiment, a heating source 31 for heating a food or keeping the food warm in a cooking chamber is operated. Also, first and second illumination lamps 33 and 35 and a color filter 36 are provided. The first and second illumination lamps 33 and 35 emit light having colors different from each other into the cooking chamber 3 according to whether the food within the cooking chamber 3 is heated, i.e., a heating mode is performed or the food within the cooking chamber 3 is kept warm, i.e., a keep-warm mode is performed.

In more detail, the first and second illumination lamps 33 and 35 emit light having the same color as each other. For example, the first and second illumination lamps 33 and 35 may emit yellow light. The color filter 36 absorbs a portion of the yellow light emitted from the second illumination lamp 35 to transmit only red light into the cooking chamber 3.

Here, another embodiment of the first and second illumination lamps 33 and 35 and the color filter 36 may be applicable. For example, the first and second illumination lamps 33 and 35 emit the red light, and the color filter 36 may absorb a portion of the red light emitted from the first illumination lamp 33 to transmit only the yellow light into the cooking chamber 3.

Configurations of a manipulation part 37 and a controller 39, which constitute a control panel 7 are equal to those of the above-described first and second embodiments. That is, the manipulation part 37 receives a manipulation signal for the cooking mode or the keep-warm mode. The controller 39 controls operations of the heating source 31 and the first and second illumination lamps 33 and 35 according to whether it is in the cooking mode or the keep-warm mode.

Hereinafter, a cooker according to a fourth embodiment will be described in detail.

Figure 5:
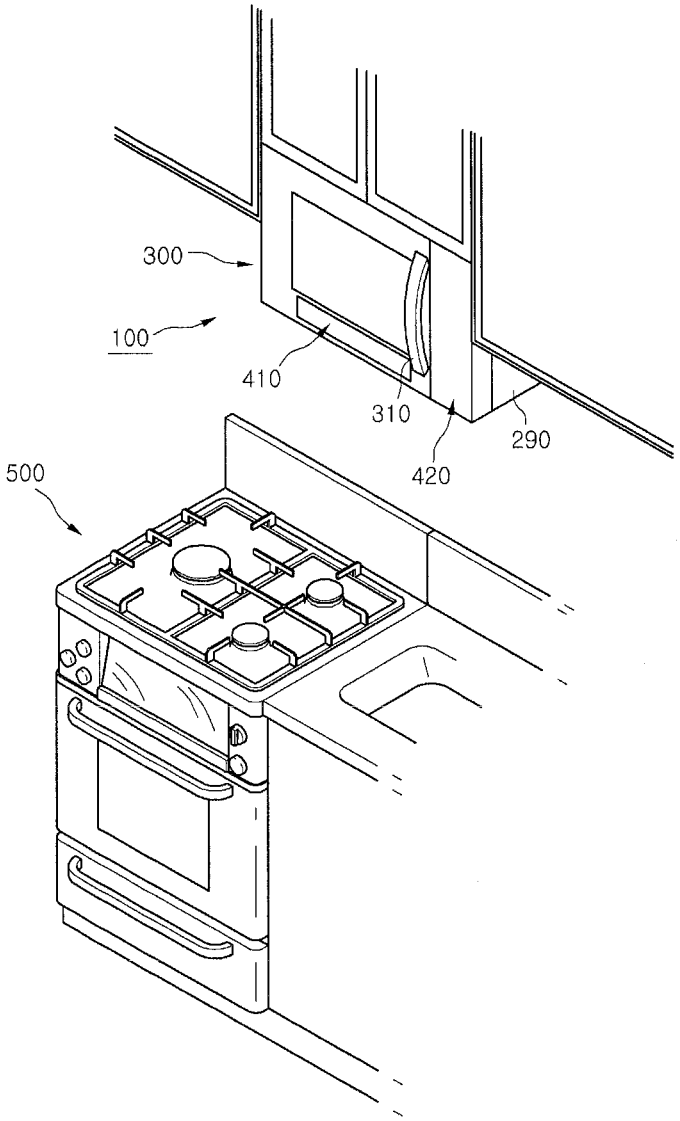
FIG. 5 is a perspective view of a state in which a cooker is installed in a kitchen according to a fourth embodiment.
Figure 6:
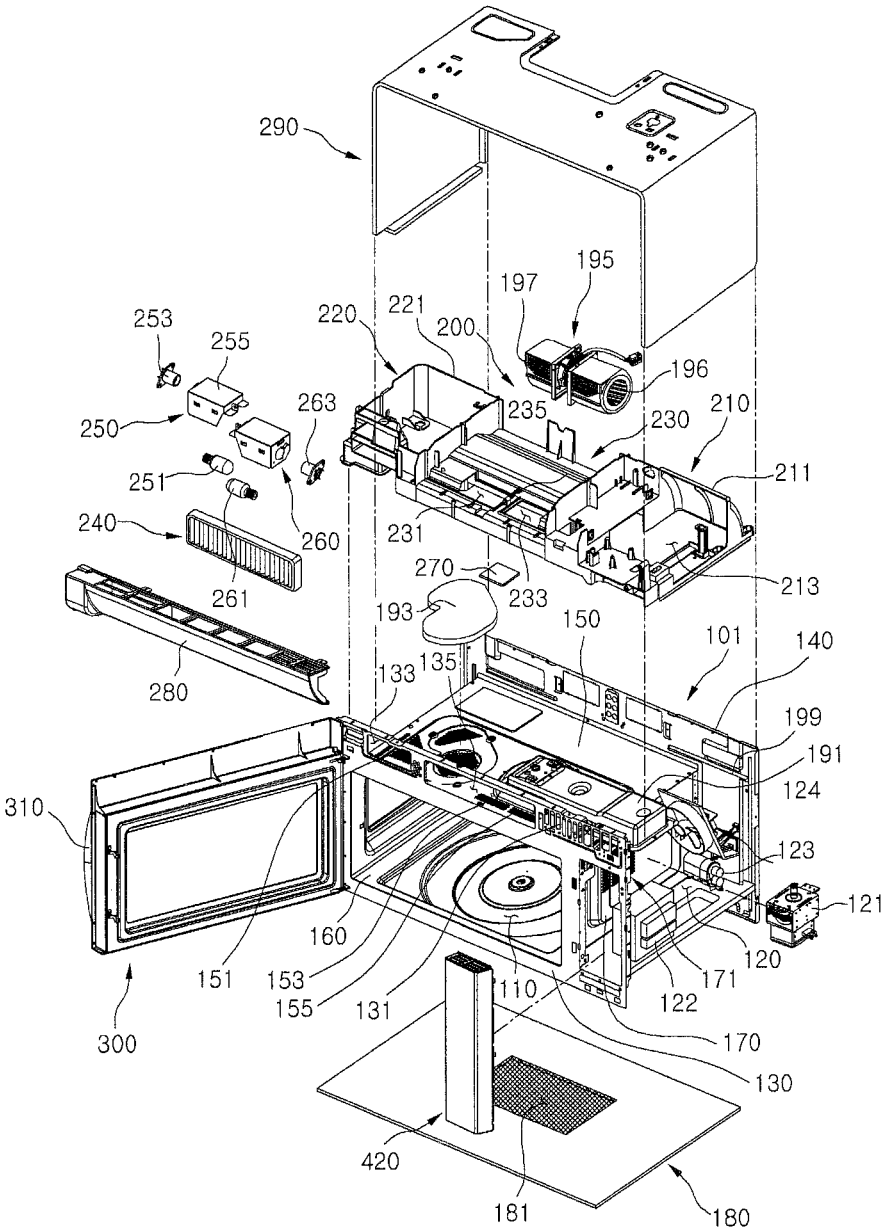
FIG. 6 is an exploded perspective view of the cooker according to the fourth embodiment.
Figure 7:
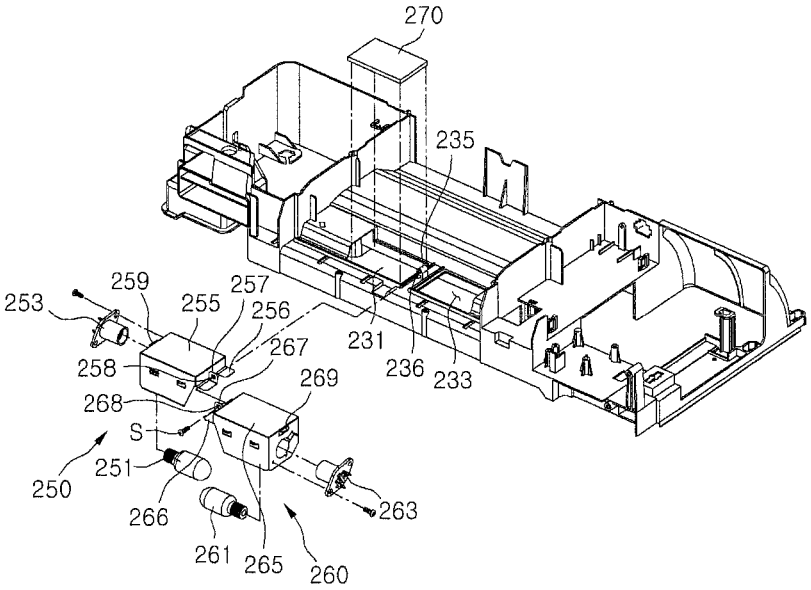
FIG. 7 is an exploded perspective view illustrating a main part of the cooker according to a fourth embodiment.

FIG. 5 is a perspective view of a state in which a cooker is installed in a kitchen according to a fourth embodiment. FIG. 6 is an exploded perspective view of the cooker according to the fourth embodiment. FIG. 7 is an exploded perspective view illustrating a main part of the cooker according to a fourth embodiment.

Referring to FIG. 5, in the current embodiment, a cooker 100 is installed in a side of a kitchen corresponding to an upper side of a gas oven range 500. For example, a gas oven range may be used as the gas oven range 500 installed below the cooker 100. The cooker 100 additionally has a hood function, which purifies combustion gas containing foreign substances generated when the food is cooked on the gas oven range 500 to discharge the purified gas to an indoor room or outdoor room.

Referring to FIG. 6, a cooking chamber 110 is defined in a cavity 101 of the cooker 100. The cooking chamber is a space in which a food is cooked or kept warm. The cooking chamber 110 is eccentrically disposed from a front surface of the cavity to a left side of FIG. 6.

An electric component chamber 120 is defined inside the cavity 101 corresponding to a side opposite to the cooking chamber 110. Various electric components such as a magnetron 121 oscillating a microwave transmitted into the cooking chamber 110, a high voltage transformer 122 supplying high voltage current to the magnetron 121, and a capacitor 123 are installed in the electric component chamber 120.

A cooling fan assembly 124 for cooling the electric components is installed in the electric component chamber 120. In more detail, the cooling fan assembly 124 generates an airflow in which air is sucked through a cooling suction hole (described later) 131 to cool the electric components, and then the air circulates inside the cooking chamber 110 and is discharged through a cooling exhaust hole (described later) 133.

A front plate 130, a back plate 140, an upper plate 150, a bottom plate 160, and two side plates 170 are disposed on a front surface, a rear surface, a top surface, a bottom surface, and both side surfaces of the cavity 101, respectively. That is, the back plate 140, the upper plate 150, the bottom plate 160, and the side plates 170 define a rear surface, a ceiling surface, a bottom surface, and both side surfaces of the cooking chamber 110, respectively. At this time, the bottom plate 160 extends to the electric component chamber 120 to substantially define also a bottom surface of the electric component chamber 120. Here, the bottom surface of the electric component chamber 120 may be defined by a separate plate different from the bottom plate 160.

The cooling suction hole 131, the cooling exhaust hole 133, and a hood exhaust hole 135 are defined in an upper end of the front plate 130. The cooling suction hole 131 is defined in an upper end of a right side of the front plate 130 when viewed from the perspective of FIG. 6. The cooling suction hole 131 serves as an inlet port through which air is sucked into the electric component chamber 120 to cool the electric components. The cooling exhaust hole 133 serves as an outlet port through which the air cooling the electric components circulates inside the cooling chamber 110 and is discharged to the outside. The cooling exhaust hole 133 is defined in an upper end of a left side of the front plate 130 when viewed from the perspective of FIG. 6. The hood exhaust hole 135 is defined in a central portion of the front plate 130 corresponding between the cooling suction hole 131 and the cooling exhaust hole 133 when viewed from the perspective of FIG. 6. The hood exhaust hole 135 serves as an outlet port through which combustion gas generated in the gas oven range 500 is purified and charged.

An exhaust porous part 151 and two illumination porous parts 153 and 155 are disposed on the upper plate 150. The exhaust porous 151 serves as an outlet port through which air discharged through the cooling exhaust hole 133 is discharged to the outside of the cooking chamber in a state where the air circulates inside the cooking chamber 110. For this, the exhaust porous part 151 is disposed in a left end of a front end of the upper plate 150 corresponding to a rear side of the cooling exhaust hole 133 when viewed from the perspective of FIG. 6. The illumination porous parts 153 and 155 illuminate the inside of the cooking chamber 110. The illumination porous parts 153 and 155 are disposed at a side of the upper plate 150 corresponding to a rear side of the hood exhaust hole 135. The illumination porous parts 153 and 155 include first and second illumination porous parts 153 and 155.

A suction porous part 171 is disposed on the right side plate of the side plates 170 when viewed from the perspective of FIG. 6. The suction porous part 171 servers as an inlet port through which the air cooling the electric components is sucked into the cooking chamber 110.

A base plate is coupled to a lower end of the cavity 101. The base plate 180 substantially defines an outer appearance of a bottom surface of the cooker 100. The base plate 180 is vertically spaced a predetermined distance from the bottom plate 160 in a state where the base plate 180 is coupled to the lower end of the cavity 101. A hood suction hole 181 is defined in the base plate 180. The hood suction hole 181 serves as an inlet port through which combustion gas generated in the gas oven range 500 is sucked.

A waveguide 191 is installed on the upper plate 150. The waveguide 191 guides the microwave oscillated in the magnetron 121 to the inside of the cooking chamber 110. The waveguide 191 has one end extending upward from the electric component chamber 120 in a state where the waveguide 191 is installed on a top surface of the upper plate 150. An antenna of the magnetron 121 is disposed on the one end of the waveguide 191 extending upward from the electric component chamber 120.

A convection device is installed on the upper plate 150. The convection device 193 includes a convection fan (not shown) and convention heater (not shown), which circulate and heat air within the cooking chamber 110. In the fourth embodiment, the convection device 193 is disposed on a left side of the upper plate 150 adjacent to the exhaust porous part 151 when viewed from the perspective of FIG. 6.

A vent fan assembly 195 is installed on a rear end of the upper plate 150. The vent fan assembly 195 generates an airflow in which combustion gas generated in the gas oven range 500 is sucked through the hood suction hole 181 and discharged through the hood exhaust hole 135. For this, a suction part 196 of the vent fan assembly 195 faces both sides, and a discharge part 197 of the vent fan assembly 195 faces upward.

An air guide 199 is disposed in the electric component chamber 120. The air guide 199 is spaced a predetermined distance from the back plate 140. The electric component chamber 120 and a hood suction passage (described later) are partitioned by the air guide 199.

An air duct 200 is installed in an upper portion of the cavity. The air duct 200 includes a cooling suction part 210, a cooling discharge part 220, and a hood exhaust part 230. The air for cooling electric components is sucked and discharged through the air duct 200, and the combustion gas generated in the gas oven range 500 is discharged through the air duct 200.

The cooling suction part 210 is disposed at a right side of the air duct 200 when viewed in FIG. 6. Substantially, the cooling suction part 210 is disposed at a portion of right side of the upper plate 150 and an upper side of the electric component chamber 120, which correspond to a rear side of the cooling suction hole 131 when viewed in FIG. 6. A cooling suction passage (described later) is disposed in the cooling suction part 210. Also, a first air barrier 211 is disposed on a left end and rear end of the cooling suction part 210 in FIG. 6. The first air barrier 211 partitions the cooling into a hood suction passage (described later) and a hood exhaust passage. A communication opening 213 communicating the cooling suction passage with the electric component chamber 120 is defined in the cooling suction part 210.

The cooling exhaust part 220 is disposed at a left side of the air duct 200 in FIG. 6. The cooling exhaust part 220 is disposed at a left upper side of the upper plate 150 corresponding to a rear side of the cooling exhaust hole 133 in FIG. 6. Thus, the cooling exhaust hole 133 is disposed substantially above the exhaust porous part 151. A cooling exhaust passage is disposed between the cooling exhaust part 22 and the upper plate 150. A second air barrier 221 is disposed at both ends of a top surface and a rear end of the cooling exhaust part 220. The hood suction passage and the hood exhaust passage are partitioned by the second air barrier 221.

The hood exhaust part 230 is disposed at a central portion of the air duct 200 corresponding between the cooling suction part 210 and the cooling exhaust hole 133 in FIG. 6. The hood exhaust part 230 is disposed as a central portion of the upper plate 150 corresponding to a rear side of the hood exhaust hole 135. Thus, the hood exhaust part 230 is disposed above the first and second illumination porous parts 153 and 155. The hood exhaust passage is disposed in the hood exhaust part 230. Also, the vent fan assembly 195 and a filter (described later) are mounted on the hood exhaust part 230. First and second illumination openings 231 and 233 are defined in the hood exhaust part 230. A portion of a bottom surface of the hood exhaust part corresponding to a vertically upper side of the first and second illumination porous parts 153 and 155 is cut to form the first and second illumination openings 231 and 233. Referring to FIGS. 6 and 7, a coupling boss 235 is disposed on the hood exhaust part 230 corresponding between the first and second illumination porous parts 153 and 155. The coupling boss 235 is disposed longitudinally on a bottom surface of the hood exhaust part 230 in front and rear directions. A coupling hole 236 to which a coupling mechanism S is coupled is defined in the coupling boss 235. The coupling hole 236 is exposed through a region vertically overlapping the hood exhaust hole 135, i.e., the hood exhaust hole 135.

A filter 240 is installed on a front end of the hood exhaust part 230. The filter 240 filters foreign substances contained in the air discharged through the hood exhaust hole 135 by an operation of the vent fan assembly 195.

First and second lamp assemblies 250 and 260 are installed in the hood exhaust part 230. The first and second lamp assemblies 250 and 260 illuminate the inside of the cooking chamber 110. In more detail, the first lamp assembly 250 is disposed in the first illumination opening 231 to illuminate the inside of the cooking chamber 110 in case of the cooking mode for cooking the food within the cooking chamber 110. The second lamp assembly 260 is disposed in the second illumination opening 233 to illuminate the inside of the cooking chamber 110 in case of the keep-warm mode for keeping the foods warm in the cooking chamber 110.

Referring to FIGS. 6 and 7, the first lamp assembly 250 includes a first lamp 251, a first lamp holder 253, and a first lamp bracket 255. The first lamp 251 emits light for illuminating the inside of the cooking chamber 110. For example, the first lamp 251 may emit yellow light. The first lamp 251 is coupled to the first lamp holder 253. The first lamp 251 and the first lamp holder 253 are installed on the first lamp bracket 255. The first lamp bracket 255 has an approximately hexahedral shape in which a portion of one (in the fourth embodiment, a right surface in FIGS. 6 and 7) of a bottom surface and an edge surface thereof is opened. A first coupling flange 256 is disposed on an upper end of the opened edge surface of the first lamp bracket 255. The first coupling flange 256 extends outwardly and perpendicularly from the opened edge surface of the first lamp bracket 255. A first coupling piece 257 is disposed on the first coupling flange 256. A portion of the first coupling piece 257 may be bent upwardly and perpendicularly with respect to the first coupling flange 256. A first through hole 258 is defined in the first coupling piece 257. The coupling mechanism s passes through the first through hole 258. A first support flange 259 is disposed on an upper end of the edge surface facing the opened edge surface of the first lamp bracket 255. The first support flange 259 extends in a direction opposite to that of the first coupling flange 256. The first coupling flange 256 and the first support flange 259 are portions on which the first lamp assembly 250, more particularly, the first lamp bracket 255 is supported by the top surface of the hood exhaust part 230 in a state where the first lamp bracket 255 is seated on the first illumination opening 231.

Also, the second lamp assembly 260 has the same component as that of the first lamp assembly 250 overall. That is, the second lamp assembly 260 is disposed in the second illumination opening 233, and includes a second lamp 261, a second lamp holder 263, and a second lamp bracket 265. The second lamp bracket 265 has an approximately rectangular parallelepiped shape in which a bottom surface thereof and a surface thereof facing the opened edge surface of the first lamp bracket 255 are opened. Also, a second coupling flange 266 and a second support flange 269 are disposed on the second lamp bracket 265. A second coupling piece 267 is disposed on the second coupling flange 266. Also, a second through hole 268 is defined in the second coupling piece 267.

The first and second coupling flanges 256 and 266 vertically overlap each other in a state where the first and second lamp assemblies 250 and 260 are installed in the first and second illumination openings 231 and 233, respectively. The first and second through holes 258 and 268 communicate with the coupling hole 236 in a front-rear direction.

A color filter 270 is disposed on the second illumination opening 233. The color filter 240 converts light emitted from the second lamp 261, i.e., the yellow light into light having a color different from the yellow color, e.g., red light. If the second lamp 261 emits light having a color different from that of the first lamp 251, the color filter 240 may be omitted.

A vent grill 280 is installed on an upper end of a front surface of the front plate 130 corresponding to the cooling suction hole 131, the cooling exhaust hole 133, and the hood exhaust hole 135. The vent grill 280 covers the cooling suction hole 131, the cooling exhaust hole 133, and the hood exhaust hole 135, and simultaneously, guides upwardly the air or combustion gas discharged through the cooling exhaust hole 133 and the hood exhaust hole 135.

An out case 290 covers the top surface and both side surfaces of the cavity 101. That is, the out case 290 defines an outer appearance of a top surface and both side surfaces of the cooker 100. Here, the upper plate and the side plates 170 are vertically or horizontally spaced a predetermined distance from the out case 290.

Referring to FIGS. 5 and 6, the cooking chamber 110 is selectively opened or closed by a door 300. The other end of the door 300 is pivotally installed in front and rear directions on the cavity 101, centered about one end thereof. A door handle 310, which is grasped by a user to rotate the door 300 is disposed on a front surface of the door 300.

A first control panel 410 is disposed on a lower end of the door 300. The first control panel 410 receives various signals for operating the cooker 100. Also, various components for display various information with respect to the operation of the cooker 100 to the outside are installed on the first control panel 410. Particularly, the first control panel 410 receives the manipulation signal for cooking the food or keeping the food warm in the cooking chamber 110.

A second control panel 420 is disposed on the front surface of the cavity 101 corresponding to a front side of the electric component chamber 120, i.e., a right portion of the front plate 130 in drawings. Various components for controlling the operation of the cooker 100 are installed on the second control panel 420.

A plurality of passages is disposed in the cooker 100. More particularly, the cooling suction passage, cooling exhaust passage, hood suction passage, and hood exhaust passage are disposed in the cooker 100. The air sucked through the cooling suction hole 131 and the air discharged through the cooling exhaust hole 133 flow into the cooling suction passage and the cooling suction passage and the cooling exhaust passage, respectively. Also, the air sucked through the hood suction hole 181 and the air discharged through the hood exhaust hole 135 flow into the hood suction passage and the hood exhaust passage, respectively.

The cooling suction passage is disposed between the cooling suction part 210 and the out case 290. The cooling suction passage communicates with the cooling suction hole 131, and also communicates with the electric component chamber 120 through the communication opening 213. The cooling exhaust passage is disposed between the upper plate 150 and the cooling exhaust part 220. The cooling exhaust passage communicates with the cooling exhaust hole 133 and the exhaust porous part 151.

Thus, when the cooling fan assembly 124 is operated, the air sucked through the vent grill 280 and the cooling suction hole 131 flows into the cooling suction passage. The air flowing into the cooling suction passage flows into the electric component chamber 120 through the communication opening 213 to cool the electric components. The air cooling the electric components flows into the cooking chamber 110 through the suction porous part 171 to circulate the inside of the cooking chamber 110, and then, the air flows into the cooling exhaust passage through the exhaust porous part 151. The air flowing into the cooling exhaust passage is discharged through the cooling exhaust hole 133 and the vent grill 280.

The hood suction passage is disposed on a lower portion of the cavity 101, both sides of the cavity 101 except the electric component chamber 120, and an upper portion of the cavity 101 except the vent fan assembly 195 and the air duct 200. Substantially, the hood suction passage is disposed between the bottom plate 160 and the base plate 180, between one of the side plates 170 and the out case 290, because the other of the side plates 170 and the out case 290 and the air guide 199, and between the upper plate 150 and the out case 290 and the air duct 200. The hood exhaust passage is disposed between the hood exhaust part 230 and the out case 290. The hood suction passage communicates with the hood suction hole 181 and the suction part 196 of the vent fan assembly 195. The hood exhaust passage communicates with the discharge part 197 of the vent fan assembly 195 and the hood exhaust hole 135.

Thus, when the vent fan assembly 195 is operated, the combustion gas generated in the gas oven range 500 is sucked through the hood suction hole 181 to flow into the hood suction passage. The combustion gas flowing into the hood suction passage is sucked into the suction part 196 of the vent fan assembly 195 and discharged through the discharge part 197 of the vent fan assembly 195. The combustion gas discharged through the discharge part 197 of the vent fan assembly 195 flows into the hood exhaust passage. The combustion gas flowing into the hood exhaust passage cools the first and second lamp assemblies 250 and 260 and is discharged through the hood exhaust hole 135 and the vent grill 280 in a state where foreign substances therein are filtered by passing through the filter 240.

Hereinafter, an effect of the cooker according to the fourth embodiment will be described.

First, a process for cooking the foods or keeping the foods warm using the cooker according to the fourth embodiment will be described.

When the user manipulates the first control panel 410 to input the manipulation signal for cooking the food, the magnetron 121 or/and the convention device 193 are operated. Thus, the food is cooked in the cooking chamber 110. In the cooking mode, the first lamp assembly 250 is operated to illuminate the inside of the cooking chamber 110. Thus, the yellow light is emitted into the cooking chamber 110. Here, the second lamp assembly 260 is not operated.

When the user manipulates the first control panel 410 to input the manipulation signal for keep the food warm, the convection device 193 is operated to perform the keep-warm mode for keeping the food warm in the cooking chamber 110. The keep-warm mode may be automatically performed after the cooking mode is completed. Also, the convection device 193 is operated to a low output when compared to the cooking mode.

When the keep-warm mode is performed, the second lamp assembly 260 is operated to illuminate the inside of the cooking chamber 110. As described above, the second lamp assembly 260, more particularly, light of the second lamp 261 is converted in color while passing through the color filter 240. That is, in the keep-warm mode, light having a color different from that of the cooking mode is emitted into the cooking chamber 110.

Thus, light having colors different from each other is emitted into the cooking chamber 110 according to whether it is in the cooking mode or the keep-warm mode. Thus, the user may easily confirm whether the cooker 100 performs the cooking mode or keep-warm mode even though the user confirms the information displayed on the first control panel 410.

Next, a process of replacing or repairing the first and/or second lamp assembly of the cooker according to the fourth embodiment will be described.

To replacing the first and/or second lamp assembly 250 and/or 260, the cooker installed in a kitchen is pulled forwardly by a predetermined distance. Then, the vent grill 280 is detached from the front plate 130. When the vent grill is detached, the coupling mechanism S is separated by inserting a tool such as a screwdriver through the hood exhaust hole 135.

In a state where the coupling mechanism S is separated, the first and/or second lamp assembly 250 and/or 260 are(is) moved upward to detach the first and/or second lamp assembly 250 and/or 260 from the first and/or illumination opening 231 and/or 233. Then, the first and/or second lamp assembly 250 and/or 260 are replaced or repaired. Then, the first and/or second lamp assembly 250 and/or 260 are(is) assembled in reverse order with respect to the above-described order.

Thus, the user may replace or repair the first and/or second lamp assembly 250 and/or 260 without completely separating the cooker 100. Also, since the tool for separating the coupling mechanism S is moved in a horizontal direction, but a vertical direction, the replacement or repair process may be easily performed.

In the above-described embodiments, although the cooker of the cooking appliances is explained as an example, any certain type of cooking appliances that is capable of cooking the food and keeping the food warm may be applicable.

Also, in the above-described fourth embodiment, although the convection device provides heat for cooking the food and keeping the food warm in the cooking chamber, the present invention is not limited thereto. That is, the convection device may provide only heat for keeping the food warm in the cooking chamber.

As describe above, the cooker according to the embodiments may expect following effects.

In the embodiments, the light having the colors different from each other is emitted according to whether it is in the cooking mode in which the food is cooked in the cooking chamber or keep-warm mode in which the food is kept warm in the cooking chamber. Thus, the user may easily confirm whether the food is cooked or kept warm.

Also, in the embodiments, one lamp serves as the heating source for keeping the food warm and the illumination source for illuminating the inside of the cooking chamber. Thus, the keeping warm of the food and the illumination of the cooking chamber may be performed through the further simple structure.

Also, in the embodiments, the first and second lamp assemblies for illuminating the inside of the cooking chamber are fixed by one coupling mechanism. Thus, the number of parts constituting the product may be reduced, and thus, manufacturing costs of the product may be reduced.

In addition, the first and/or second lamp assembly may be replaced or repaired without completely separating the cooker from the installed place. Thus, serviceability of the product may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A cooker, comprising:

a cavity having a cooking chamber eccentrically disposed on a front surface thereof;

a hood exhaust passage disposed on an upper portion of the cavity;

a vent fan assembly that generates an airflow flowing into the hood exhaust passage;

a heating source disposed at a side of a top surface of the cavity except the hood exhaust passage, the heating source providing heat to keep food warm in at least the cooking chamber; and an illumination device disposed above the hood exhaust passage, the illumination device emitting light having colors different from each other according to whether it is in a cooking mode, in which the food is cooked in the cooking chamber, or a keep-warm mode, in which the food is kept warm in the cooking chamber.

2. The cooker according to claim 1, wherein the heating source comprises at least one of a convection heater or a convection device that convectively heat the food within the cooking chamber, an upper heater that radiatively heats the food within the cooking chamber, and a magnetron oscillating a microwave supplied into the cooking chamber.

3. The cooker according to claim 1, wherein the hood exhaust passage is disposed at a center of a top surface of the cavity, and the heating source is installed at a side of the top surface of the cavity except the hood exhaust passage.

4. The cooker according to claim 1, wherein the hood exhaust passage is longitudinally disposed in a front-rear direction at a center of a top surface of the cavity, and the illumination device is disposed on a front end of the center of the top surface of the cavity.

5. The cooker according to claim 1, wherein the illumination device emits light having colors different from each other in a case of keeping the food warm and in a case of cooking the food.

6. The cooker according to claim 1, wherein the illumination device emits white light in a case of cooking the food and red light in a case of keeping the food warm.

7. The cooker according to claim 1, wherein the illumination device comprises:

a first illumination source that emits white light when the food is cooked; and a second illumination source that emits red light when the food is kept warm.

8. The cooker according to claim 1, wherein the illumination device comprises:

a first illumination source that emits white light when the food is cooked;

a second illumination source that emits white light when the food is kept warm; and a color filter that converts the white light of the second illumination source into red light to transmit the converted red light into the cooking chamber.

9. A cooker, comprising:

a cavity having a cooking chamber in which food is cooked or kept warm;

an air duct disposed on a top surface of the cavity, the air duct having a hood exhaust passage;

a heating source disposed on a top surface of the air duct except the hood exhaust passage, the heating source providing heat to cook the food or keeping the food warm in the cooking chamber; and an illumination device disposed above the hood exhaust passage, the illumination device illuminating an inside of the cooking chamber.

10. The cooker according to claim 9, wherein the illumination device comprises:

a first illumination source that illuminates the inside of the cooking chamber when the food is cooked; and a second illumination source that illuminates the inside of the cooking chamber when the food is kept warm.

11. The cooker according to claim 10, wherein the first and second illumination sources are coupled to each other using one coupling mechanism.

12. The cooker according to claim 11, wherein the coupling mechanism passes through a first through hole defined in the first illumination source and a second through hole defined in the second illumination source, and is coupled to a coupling hole defined in the air duct.

13. The cooker according to claim 11, wherein the first illumination source comprises a first illumination lamp that emits light, and a first lamp bracket, in which the first illumination lamp is disposed and the first through hole is defined, and the second illumination source comprises a second illumination lamp that emits light and a second lamp bracket in which the second illumination lamp is disposed and the second through hole is defined.

14. The cooker according to claim 13, wherein the first and second lamp brackets ate seated on seat openings defined in the air duct, respectively.

15. The cooker according to claim 14, wherein the first and second lamp brackets partially overlap each other in a state in which the first and second lamp brackets are seated on the seat openings, respectively.

16. The cooker according to claim 14, wherein a color filter is disposed on the seat opening on which the second illumination lamp is disposed, and wherein the color filter converts a color of the light of the second illumination lamp and transmits the converted light into the cooking chamber when the food is kept warm.

17. The cooker according to claim 11, wherein the coupling mechanism is disposed on a front surface of the cavity and exposed to the outside through a hood exhaust hole that communicates with the hood exhaust passage.

18. The cooker according to claim 9, wherein the illumination device comprises:

a first illumination source that emits light having a preset color to illuminate the inside of the cooking chamber when the food is cooked;

a second illumination source that emits light having the same color as that of the first illumination source to illuminate the inside of the cooking chamber when the food is kept warm; and a color filter that converts the color of the light of the second illumination source to transmit the light having the converted color into the cooking chamber.

* * * * *